United States Patent [19]

Prather et al.

[11] 4,079,810

[45] Mar. 21, 1978

[54] MUFFLER

[75] Inventors: David Marshall Prather; Graham Frederick Thieman, both of Columbus, Ind.

[73] Assignee: Arvin Industries, Inc., Columbus, Ind.

[21] Appl. No.: 694,684

[22] Filed: Jun. 10, 1976

[51] Int. Cl.[2] ..... F01N 1/08

[52] U.S. Cl. ..... 181/266; 181/272; 181/273

[58] Field of Search ..... 181/54, 53, 57, 59, 181/49, 265, 266, 272, 273, 269

[56] References Cited

U.S. PATENT DOCUMENTS

| | | | |
|---|---|---|---|
| 2,337,299 | 12/1943 | Noblitt et al. | 181/54 |
| 2,960,179 | 11/1960 | Bryant | 181/53 |
| 3,469,653 | 9/1969 | Vautlaw et al. | 181/54 |
| 3,581,842 | 6/1971 | Hall | 181/54 |
| 3,741,336 | 6/1973 | Malosh | 181/54 |
| 3,771,315 | 11/1973 | Scott | 181/36 C |

*Primary Examiner*—Stephen J. Tomsky
*Attorney, Agent, or Firm*—Jenkins, Coffey & Hyland

[57] ABSTRACT

A muffler which does not require a low-frequency Helmholtz resonator includes an outer shell and first and second heads for closing the inlet and outlet ends, respectively, of the shell. First, second and third baffles are disposed internally of the shell and extend transversely therein. An outlet end chamber is defined between the inlet head and first baffle. A second chamber is defined between the first and second baffles. A third chamber is defined between the second and third baffles. An inlet end chamber is defined between the third baffle and outlet head. An inlet conducting tube extends longitudinally of the shell through the inlet head and the first, second and third baffles and opens into the inlet end chamber. An outlet conducting tube extends through the outlet head and the first, second and third baffles and opens into the outlet end chamber. An aperture in the first baffle acoustically couples the outlet end chamber and second chamber. An aperture in the third baffle acoustically couples the inlet end chamber and third chamber. One or more apertures in the second baffle acoustically and resistively couple the second and third chambers.

12 Claims, 4 Drawing Figures

MUFFLER

This invention relates to mufflers for decreasing exhaust gas noise from internal combustion engines.

There are several known types of mufflers for reducing exhaust gas noise from internal combustion engines. Such mufflers conventionally include a number of internal conducting tubes and baffles which define, internally of the mufflers, one or more low-frequency resonating chambers. Such chambers are incorporated into mufflers to remove audible low-frequency components from exhaust noise. A common characteristic of such low-frequency resonating chambers is that they consume relatively large amounts of the space provided within the shells of typical mufflers. Another characteristic of such chambers is that they typically require an additional baffle, and frequently an additional length of conducting tubing must be incorporated in muffler construction. Thus, mufflers which incorporate such low-frequency resonating chambers are often more expensive and difficult to manufacture than mufflers without such chambers. Heretofore, however, the desirability to incorporate such chambers to minimize certain low-frequency components in the exhaust gas noise of internal combustion engines has been sufficient to justify their inclusion in mufflers.

Examples of such low-frequency resonating chambers are found in the following U.S. Pat. Nos. 2,070,543 issued to Cary et al and titled MUFFLER; 2,337,299 issued to Noblitt et al and titled MUFFLER; 2,652,128 issued to Cary and titled RETROVERTED PASSAGE TYPE MUFFLER WITH EXPANSION CHAMBERS; 2,934,161 issued to Powers and titled MUFFLER; 3,036,654 issued to Powers and titled MUFFLER CONSTRUCTION; and 3,469,653 issued to Vautaw et al and titled MUFFLER.

It is an object of the present invention to provide a muffler of simpler and less expensive construction than prior art mufflers, yet which will achieve significant attenuation of audible low-frequency components in exhaust gas noise. The instant muffler provides significant low-frequency attenuation without the addition baffle or the additional length of tubing found in prior art mufflers containing low-frequency resonating chambers of the type commonly referred to as Helmholtz resonators.

In accordance with the invention, a muffler includes an outer shell, first and second heads for closing the ends of the shell, and first and second tubes for conducting gas into and out of the muffler, respectively. The first head includes an aperture which sealingly receives the first conducting tube. The second head includes an aperture which sealingly receives the second conducting tube. Within the shell, and disposed between the first and second head, are first, second, and third longitudinally spaced apart, transversely extending baffles. The first head and first baffle define therebetween a first end chamber. The first and second baffles define therebetween a second chamber. The second and third baffles define therebetween a third chamber. The third baffle and second head define therebetween a fourth chamber which is a second end chamber. The first conducting tube extends into, and opens into, the second end chamber and the second conducting tube extends into, and opens into, the first end chamber. A first aperture in the first baffle acoustically couples the first end chamber and second chamber. A second aperture in the third baffle acoustically couples the second end chamber and third chamber. A plurality of apertures having a combined area relatively smaller than either of the first or second apertures are desirably provided in the second baffle resistively and acoustically to couple the second and third chambers to attenuate low-frequency noise in exhaust gas.

Further according to an embodiment of the present invention, each of the first, second and third baffles sealingly engages the outer wall of each of the first and second conducting tubes. The first conducting tube includes a plurality of apertures which acoustically couple the interior of the first conducting tube and the first end chamber. Each of the first and second conducting tubes includes a louver patch disposed in the second chamber for acoustically coupling the interiors of the first and second tubes within the second chamber. Some acoustical "shorting" from the first, or inlet, conducting tube over to the second, or outlet, conducting tube in the first and second chambers is thereby permitted.

Further, according to an embodiment of the present invention, the second conducting tube comprises a section extending longitudinally and coaxially thereof, which comprises generally concentric inner and outer tube portions. The inner and outer tube portions define therebetween a space. The outer tube portion acoustically seals the second conducting tube from those chambers through which the outer tube portion extends. The inner tube portion is provided with a plurality of apertures for acoustically coupling the interior of the second conducting tube to the defined space. A high-frequency exhaust gas noise resonator is thus formed.

The invention can best be understood by referring to the following description and accompanying drawings which illustrate an embodiment of the invention. In the drawings.

Figures 1, 2:
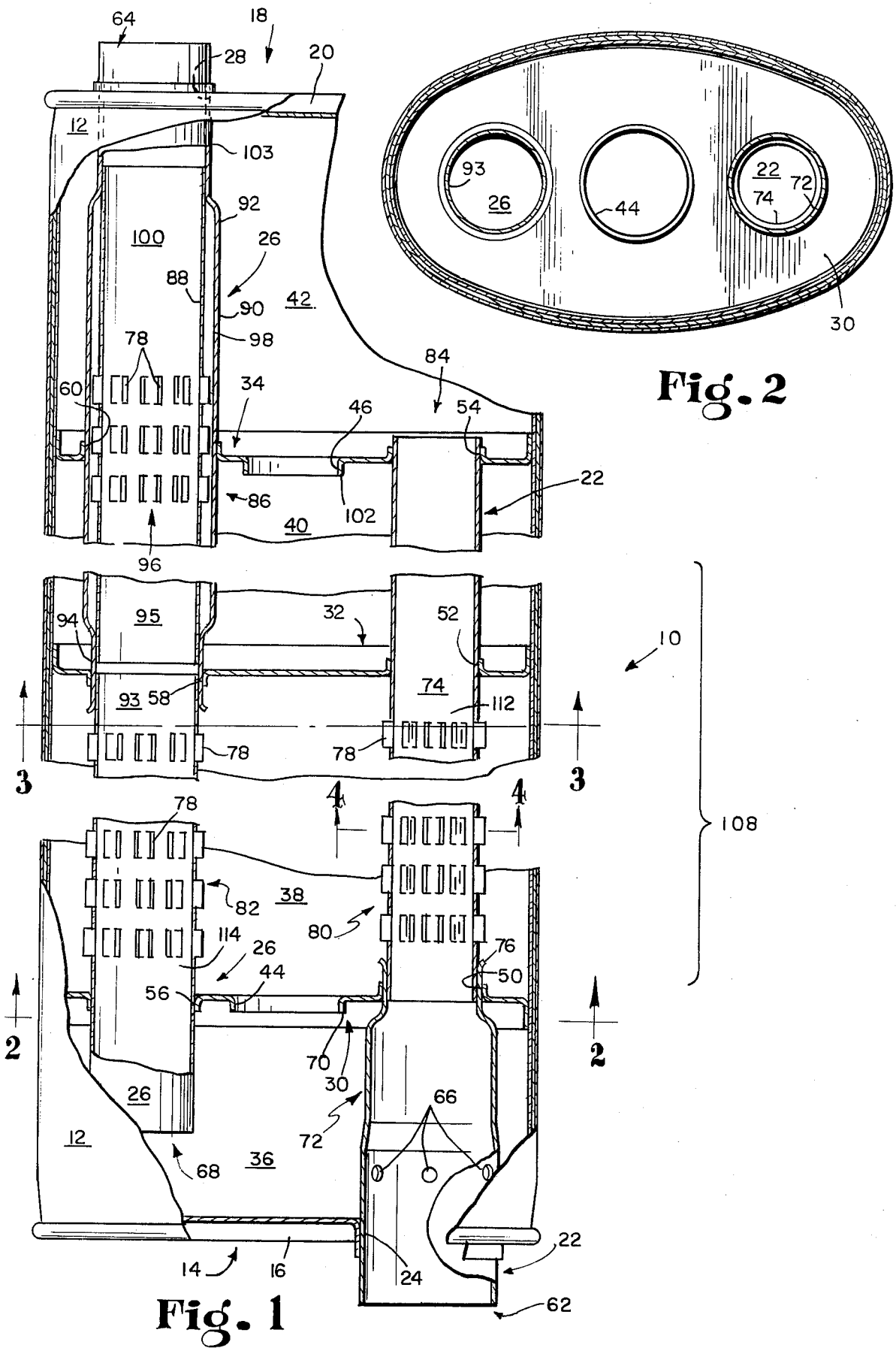
FIG. 1 is a top plan view of a muffler constructed in accordance with the present invention, with an upper portion of the shell removed to show details of the interior construction of the muffler.
FIG. 2 is a sectional view of the muffler of FIG. 1 taken along section lines 2—2 thereof.

Referring now particularly to FIG. 1, the muffler 10 comprises an outer shell 12 closed at a first, or inlet, end 14 by an inlet head 16. Shell 12 is closed at an outlet end 18 by an outlet head 20. A first, or inlet, conducting tube 22 is sealingly received through an aperture 24 in inlet head 16. A second, or outlet, conducting tube 26 is sealingly received in an aperture 28 in outlet head 20.

Within shell 12 are located first, second, and third baffles 30, 32, 34, respectively. Baffles 30, 32, 34 define within shell 12 first, second, third, and fourth chambers 36, 38, 40, 42, respectively. Chamber 36 is a first, or outlet, end chamber and chamber 42 is a second, or inlet, end chamber. Chamber 36 is defined by shell 12, inlet head 16, and first baffle 30. Chamber 38 is defined by the shell, the first baffle 30 and second baffle 32. Chamber 40 is defined by the shell, second baffle 32, and third baffle 34. Chamber 42 is defined by the shell, baffle 34, and outlet head 20.

Figure 3:
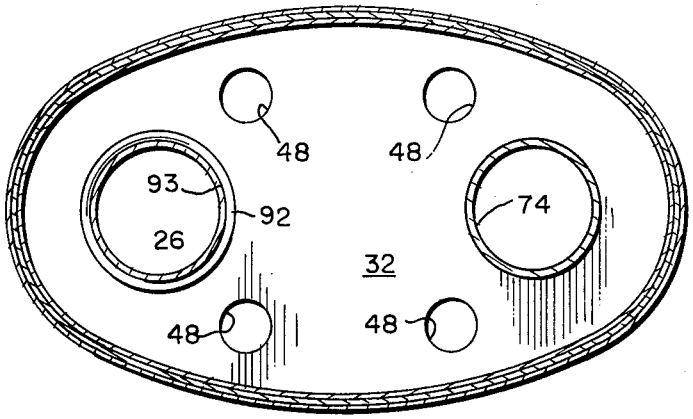
FIG. 3 is a sectional view of the muffler of FIG. 1 taken along section lines 3—3 thereof.

Inlet conducting tube 22 extends through baffles 30, 32, and 34, and opens into chamber 42. Outlet conducting tube 26 extends through baffles 30, 32, and 34, and opens into end chamber 36. A first aperture 44 in baffle 30 acoustically couples chambers 36 and 38. A second aperture 46 in baffle 34 acoustically couples chamber 40 and 42. A plurality of apertures 48 (FIG. 3) in baffle 32 acoustically couple chambers 38 and 40. In the instant embodiment, there are four such apertures 48 located as illustrated in FIG. 3.

Inlet conducting tube 22 is sealingly received in apertures 50, 52, 54 of baffles 30, 32, 34, respectively. Tube 22 extends into, and opens into, chamber 42. Tube 22 is formed to provide, outside of inlet head 16, an inlet connecting nipple 62.

Outlet conducting tube 26 is sealingly received in apertures 56, 58, 60, in baffles 30, 32, 34, respectively. Tube 26 extends into, and opens into, chamber 36. At the outer end of tube 26, an outlet connecting nipple 64 is formed.

Within chamber 36, a plurality of apertures 66 are formed in the wall of tube 22. Apertures 66 acoustically couple the interior of tube 22 to chamber 36. This provides acoustical coupling of tube 22 directly to the open, interior end 68 of outlet conducting tube 26. An extruded flange 70 extends into chamber 36 from the periphery of first aperture 44. Within chamber 36, tube 22 is formed to include a reducing section 72 which reduces the tube 22 diameter from the diameter of connecting nipple 62 to approximately the diameter of a section 74 of tube 22. Tube section 74 is sleeved into the interior end 76 of reducing section 72. The fit of tube section 74 into the interior end 76 of section 72 is a sliding and sealing fit. Section 72 is secured, e.g., by welding, in aperture 50 in the first baffle 30. Outlet conducting tube 26 is similarly secured in aperture 56 of baffle 30. Inlet conducting tube 22 is received through aperture 52 of baffle 32 and secured therein, e.g., by welding. Inlet conducting tube 22 is slidingly and sealingly received in aperture 54 in baffle 34. The interior end 84 of tube 22 opens into inlet end chamber 42.

Figure 4:
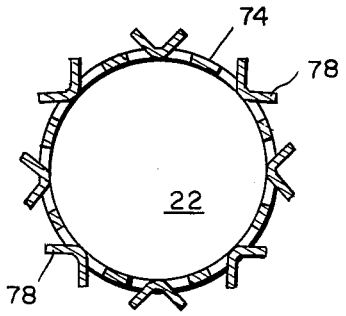
FIG. 4 is a partial sectional view of the muffler of FIG. 1 taken along section lines 4—4 thereof.

Within chamber 38, each of conducting tubes 22, 26 is provided with a plurality of louvers 78 to couple tubes 22, 26 acoustically within chamber 38. There are thus defined on tubes 22, 26, louver patches 80, 82, respectively. The cross sections of both of louver patches 80, 82 are as illustrated in FIG. 4, a transverse section of louver patch 80.

Acoustical coupling of tubes 22 and 26 in chamber 38 provides some acoustical "shorting" from tube 22 through chamber 38 and into tube 26. The cross sectional area of first aperture 44 can be varied according to the needs of a particular application to increase or decrease such shorting.

Rearwardly from louver patch 82, outlet conducting tube 26 includes a double-wall portion 86. The inner wall 88 of this portion is the wall of tube 26. The outer wall 90 is formed by a sleeve 92 having a diameter somewhat larger than that of tube 26, and a cross-sectional shape substantially the same as that of tube 26. Sleeve 92 is reduced at its forward end 94 slidingly and snugly to engage two sections 93, 95 of tube 26. Sleeve 92 extends through aperture 58 in baffle 32 and is secured therein, e.g., by welding. Within sleeve 92, inner wall 88 includes a plurality of apertures or louvers 78 formed to provide a louver patch 96. Louver patch 96 acoustically couples the interior of tube 26 to the space 98 defined between walls 88, 90. This construction provides a high-frequency resonating region 100 which attenuates high-frequency noise in the exhaust gas passing through muffler 10.

Sleeve 92 is slidingly received in aperture 60 of baffle 34. Sleeve 92 extends rearwardly with tube 26 and is reduced at 103 and secured to head 20. Section 95 of tube 26 is secured in the reduced portion 103 of sleeve 92, e.g., by welding. In the illustrated embodiment, sleeve 92 extends outwardly through aperture 28 of outlet head 20 to form outlet connecting nipple 64. Baffle 34 provides, around the periphery of second aperture 46, a flange 102 which extends into chamber 40. Baffles 30, 32, 34 are all secured within shell 12 about their peripheries by suitable means, e.g., welding.

It will be noted that the instant muffler does not contain the conventional low-frequency resonating chamber or Helmholtz resonator. To achieve significant attenuation of low-frequency sound in the exhaust gas noise from muffler 10, baffle 32 is provided with the aforementioned plurality of apertures 48 (FIG. 3). Apertures 48 are of sufficiently small size to couple the second and third chambers 38, 40, respectively, acoustically and restrictively. Chambers 38, 40 combined form a relatively large expansion chamber 108 with internal restriction, i.e., baffle 32 with apertures 48. Chamber 108 provides significant attenuation for low-frequency components in the exhaust gas noise without contributing the additional baffle and conducting tube that a low-frequency Helmholtz resonator conventionally adds to muffler construction.

The distance from the rearward extent 112 of louver patch 80 to the opening 84 of inlet conducting tube 22 is defined as the active length of tube 22. Similarly, the distance from opening 68 of outlet conducting tube 26 to the forward extent 114 of louver patch 82 is defined as the active length of tube 26. By varying these active lengths, the noise attenuating characteristics of the muffler can be desirably altered. Such variation is referred to as "tuning" of the inlet and outlet tubes 22, 26 to the characteristics of their respective inlet and outlet end chambers 42, 36.

As will be appreciated from FIGS. 2–3, apertures 48 in baffle 32 are not longitudinally aligned with apertures 44, 46 in baffles 30, 34, respectively. This misalignment aids to promote the sound-deadening quality of the illustrated muffler. Further, as will be appreciated from FIG. 3, the cross-sectional area of each of apertures 48 is substantially less than the minimum cross-sectional area of inlet conducting tube 22. In the illustrated embodiment, the ratio of the area of each of apertures 48 to the minimum area of tube 22 is approximately 0.15. Further, the ratio of the combined areas of all of apertures 48 to the minimum area of conducting tube 22 is relatively less than 1. In this embodiment, that ratio is approximately 0.6.

What is claimed is:

1. A muffler comprising a longitudinally extending outer shell, first and second heads for closing the ends of the shell, first and second tubes for conducting gas into and out of the muffler, respectively, the first head including means for providing an aperture for sealingly receiving the first conducting tube and the second head including means for defining an aperture for sealingly receiving the second conducting tube, first, second and third longitudinally spaced apart, transversely extending baffles for defining between the first and second heads, respectively, a first end chamber, a second chamber, a third chamber, and a second end chamber, the first end chamber being defined by the first head and first baffle, the third baffle and second head defining therebetween the second end chamber, the first and second baffles defining therebetween the second chamber and the second and third baffles defining therebetween the third chamber, the first conducting tube extending into and opening into the second end chamber and the second conducting tube extending into and opening into the first end chamber, each of the first and second conducting tubes having a plurality of apertures in the second chamber and having active length portions and including a portion having a gas-impermeable side wall in the third chamber to prevent bleeding of exhaust gas into the second conducting tube from the first conducting tube in the third chamber, each of the first, second and third baffles including means defining apertures for tightly engaging the first and second conducting tubes, the first baffle defining a first aperture for acoustically coupling the first end chamber and second chamber, the third baffle defining a second aperture for acoustically coupling the second end chamber and third chamber, and the second baffle defining a plurality of third apertures for providing resistive acoustical coupling of the second and third chambers for reducing noise, each of the third apertures being out of longitudinal alignment with the first and second apertures and having a cross-sectional area substantially less than the cross-sectional area of the first conducting tube, and the combined cross-sectional areas of the third apertures being relatively less than the cross-sectional area of the first conducting tube.

2. The invention of claim 1 wherein the active length of the inlet conducting tube is sufficient to tune the inlet conducting tube to the characteristics of the second end chamber.

3. The invention of claim 1 wherein the active length of the outlet conducting tube is sufficient to tune the outlet conducting tube to the characteristics of the first chamber.

4. The invention of claim 1 wherein the first conducting tube further includes means defining a plurality of apertures for acoustically coupling the first conducting tube and the first end chamber.

5. The invention of claim 1 wherein the second conducting tube further comprises a section extending longitudinally thereof, which section comprises inner and outer generally concentric tube portions, the inner and outer tube portions defining a space therebetween, the outer tube portion including a gas impermeable wall and the inner tube portion being provided with a plurality of apertures for acoustically coupling the interior of the second conducting tube to the space defined between the inner and outer tube portions.

6. The invention of claim 1 and further comprising a first flange surrounding the first aperture and extending into the first end chamber.

7. The invention of claim 1 and further comprising a second flange surrounding the second aperture and extending into the third chamber.

8. A muffler comprising a shell, an inlet head and an outlet head for closing the inlet and outlet ends respectively of the shell, an inlet conducting tube for providing a passageway through the inlet head for conducting gas therethrough into the muffler, an outlet conducting tube for providing a passageway through the outlet head for conducting gas therethrough from the muffler, wherein the improvement comprises first, second and third baffles for supporting said inlet conducting tube and said outlet conducting tube, said first, second and third baffles being serially arranged within the shell intermediate the inlet and outlet heads, said inlet head and first baffle defining a first chamber, said first and second baffles defining a second chamber, said second and third baffles defining a third chamber, and said third baffle and outlet head defining a fourth chamber, said first baffle further including a first aperture for providing a passageway between the first and second chambers, the outlet conducting tube extending through the first, second and third baffles and opening into the first chamber, the third baffle including a second aperture for providing a passageway between the third and fourth chambers, the inlet conducting tube extending through the first, second and third baffles and opening into the fourth chamber, each of the inlet and outlet tubes having a plurality of apertures in the second chamber and including a gas-impermeable portion in the third chamber to prevent leakage across the third chamber from the inlet conducting tube to the outlet conducting tube, the second baffle including a plurality of third apertures for providing resistive acoustical coupling between the second and third chambers to reduce exhaust noise, each of the third apertures being out of longitudinal alignment with the first and second apertures and having a cross-sectional area substantially less than the cross-sectional area of the inlet conducting tube, the combined areas of the third apertures being relatively less than the cross-sectional area of the inlet conducting tube.

9. The invention of claim 8 wherein the outlet conducting tube includes, intermediate its ends, a high-frequency resonator.

10. The invention of claim 9 wherein the high-frequency resonator comprises part of the length of the outlet tube having generally concentric inner and outer walls defining a space therebetween, the outer wall being impervious to gas flow therethrough and the inner wall defining a plurality of apertures for acoustically coupling the interior of the outlet conducting tube to the space.

11. The invention of claim 8 wherein the first aperture provides resistive flow of gas from the second chamber into the first chamber, thereby increasing acoustical shorting from said inlet tube to said outlet tube through said pluralities of apertures.

12. The invention of claim 8 wherein the inlet conducting tube includes a plurality of radially extending apertures for acoustically coupling the inlet conducting tube and the first chamber.

* * * * *